United States Patent [19]

Takeuchi et al.

[11] Patent Number: 4,512,435

[45] Date of Patent: Apr. 23, 1985

[54] DIAPHRAGM FOR LOUDSPEAKERS

[75] Inventors: Hiroshi Takeuchi, Matsubara; Yoshiaki Maruno, Hirakata, both of Japan

[73] Assignee: Matsushita Electric Industrial Co., Ltd., Kadoma, Japan

[21] Appl. No.: 475,965

[22] Filed: Mar. 16, 1983

[30] Foreign Application Priority Data

Mar. 16, 1982 [JP] Japan ..... 57-42053
Mar. 17, 1982 [JP] Japan ..... 57-43495
Mar. 17, 1982 [JP] Japan ..... 57-43496

[51] Int. Cl.[3] ..... H04R 7/06; H04R 7/14

[52] U.S. Cl. ..... 181/170; 181/168; 181/164

[58] Field of Search ..... 181/157, 160, 161, 148, 181/164, 165, 168, 170, 179, 158, 167

[56] References Cited

U.S. PATENT DOCUMENTS 4,135,601 1/1979 Tsukagoshi et al. ..... 181/170 X
4,254,184 3/1981 Tsukagoshi et al. ..... 181/168

*Primary Examiner*—John Gonzales
*Assistant Examiner*—Brian W. Brown
*Attorney, Agent, or Firm*—Birch, Stewart, Kolasch & Birch

[57] ABSTRACT

The present invention is directed to a diaphragm for loudspeakers which is integrally constructed through the combination of a core material being formed as a disc-shaped solid construction through the independent or series of combination of a plurality of flat-plate pieces and disc-shaped skin materials each being approximately equal in diameter on the top face and the bottom face of disc-shaped core material, the core material and skin materials being made of either boron or beryllium, thus resulting in the higher efficiency, wider zone and lower distortion of the loudspeakers.

5 Claims, 12 Drawing Figures

DIAPHRAGM FOR LOUDSPEAKERS

BACKGROUND OF THE INVENTION

1. Field of the Invention

The present invention relates to a diaphragm for loudspeakers. More specifically, the present invention relates to a diaphragm for loudspeakers, which is lighter in weight, and higher in performance in the use of a base material made of a material low in density and high in modulus of elasticity.

2. Description of the Prior Art

Generally it is considered ideal that the diaphragm for loudspeakers follows, with sufficient linearity, the driving force given by an electromagnetic conversion system within the working frequency zone, and the entire face thereof vibrated (piston vibration) at the same phase. A so-called flat diaphragm whose radiation face is flat is considered ideal in terms of sound-wave radiation characteristics. According to the flat diaphragm, to prevent split resonance from spreading the piston vibration range, the rigidity, which was due to the profile effect in a cam type or a dome type, was depended upon the thickness of the diaphragm. As a result, the weight of the diaphragm was increased, thus decreasing the performance of the loudspeaker. As a method of overcoming this defect, a diaphragm was used of a sandwich structure wherein a skin material was bonded on the surface of a hollow core base material. However, the light-weight effect was not sufficiently provided, even if the rigidity was enhanced to a certain degree, by the use of such a sandwich structure as described above. To further increase the light-weight effect, the material, which was used to make the sandwich structure, was made thinner to reduce the weight. However, the mechanical strength was reduced causing buckling, deformation during the assembling operation and partial resonance (face-flutter phenomenon) during the operation, thus deteriorating the acoustic characteristics.

To improve the weight defect in such a flat diaphragm as described above, a material, having a low density and a high modulus of elasticity is desired. Aluminum or titanium was chiefly used as the general material for an acoustic transducer. Also, in the diaphragm of such sandwich structure as described above, the balance between the properties of the matter used for the skin material and the base material was important. When a skin material of beryllium, boron or the like was combined with a base material of aluminum, the degree of contribution towards the characteristics of the diaphragm due to the property of the matter was lower as compared with the case where aluminum or titanium was used as the skin material. Thus, it has been difficult to sufficiently rely upon the property of the skin material. A honey-comb material, a ribbon braided material, etc. have been put in use as a base material of a hollow core of a diaphragm for a loudspeaker made as a sandwich structure. The honey-comb material had the disadvantage of a lower weight-decrease degree, because the cells become partially double. The ribbon braided material had the disadvantage in that the long ribbon had to be bent into a small diameter, thus effecting the working property of the material and complicating the braiding process, whereby the productivity became inferior.

SUMMARY OF THE INVENTION

The present invention is provided to remove the above-described conventional disadvantages by the employment of a skin material spliced onto a three-dimensional, hollow base-material made of boron or beryllium, of an optical shape.

A principal object of the present invention is to provide a diaphragm for loudspeakers, which is lighter in weight, and higher in performance by the use of a base material made of a material such as boron, beryllium or the like, which is low in density and high in modulus of elasticity.

Another object of the present invention is to provide a diaphragm for loudspeakers wherein the boron or beryllium, which is low in density and high in modulus of elasticity, is made as a base material independent of the mechanical working property.

The present invention is to provide a diaphragm for loudspeakers wherein disc-shaped skin materials each being of approximately the same diameter, are spliced, into an integral construction, on both faces, top and bottom, of a disc-shaped core material, the core material and skin materials being made of either boron or beryllium. The core material is formed as a disc-shaped solid construction through the independent or series of combination of a plurality of base materials each being formed of a flat-plate piece.

The base material and the skin material are made in such a manner so as to vary at least by one the number of ions incident to the base plate and the amount of kinetic energy of the ion, in a process wherein a boron film or a beryllium film is produced on the base plate by a physical vapor-phase development method (hereinafter referred to as PVD method). This has an advantage in that the shape distortion, caused by inner stress remaining in the formed film when the thin-film layer has been produced by the vapor-phase development method, is eliminated to provide a base material or a skin material which is smaller in camber due to the residual stress, thus allowing the base material and the skin material to be spliced with each other without rupture during the thermal pressure adherence with a bonding agent.

The base material may be three-dimensional and optional in shape. However, when the base material is made of a boron or beryllium-formed monofilm, it is effective to basically have an isotropic distribution of density with ribs being disposed in radial directions from the center in terms of the formation working property and the separating property of the basic plate, which is used to form the film of boron or beryllium by the PVD method using ionized particles.

In another preferred embodiment of the present invention, a plurality of core units, each being hair-pin-shaped or approximately U-shaped, are disposed in radial directions to serve as hollow base materials. Skin material made of beryllium or boron are spliced on the surfaces of the base materials. According to such a construction as described above, the base material is composed of a plurality of core units disposed in a radial direction, the core units of simple form each being hair-pin-shaped or approximately U-shaped. The beryllium or boron, which is a material of low density and high elasticity modulus, is hardly influenced by an inferior mechanical working property in the application thereof. Thus, this is the reason why a base material made of a material, such as boron, beryllium or the like, of low density and high elasticity modulus can be used, and a diaphragm for loudspeakers, which is light in weight and high in performance, can be provided.

The base material of the present invention makes it possible to have the isotropic distribution density, with ribs being disposed in radial directions from the center of the diaphragm. To apply a material, such as beryllium, boron or the like, which is inferior in mechanical working property, a collective body of core units formed by a vapor-phase development method is used. Furthermore, to improve the productivity during the assembling, and bonding operation, the shape is rendered a solid hair-pin, such as U-shaped, trapezoidal shape or the like thereby to improve strength with respect to the torsional stress.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 11 is a plan view of a diaphragm of FIG. 10; and

DESCRIPTION OF THE PREFERRED EMBODIMENTS

Figure 1:
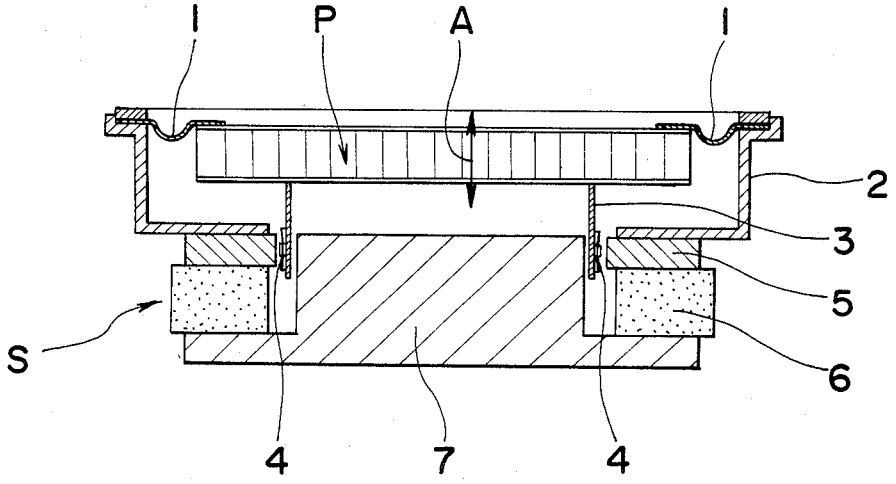
FIG. 1 is a cross-sectional view of a speaker using a diaphragm of the present invention.

FIG. 1 shows a loudspeaker using a diaphragm of the present invention which is a integrally constructed through the combination of disc-shaped skin materials each being approximately equal in diameter on the top face and the bottom face of a disc-shaped core material, the core material being formed as a disc-shaped solid construction through the independent or series of combination of a plurality of flat-plate pieces, the core material and skin materials being made of either boron or beryllium.

Referring to FIG. 1, a diaphragm P is secured, in the outer peripheral edge of its top face, to the frame 2 of speaker S through a support piece 1. A bobbin 3 is secured to the under face of the diaphragm P. A voice coil 4 is disposed on the outer side of the lower end of the bobbin 3. A magnet 6 is secured through a plate 5 to the under portion of the frame 2. A yoke 7 is secured to the magnet 6 to cause the voice coil 4 to face the plate 5. A magnetic circuit is formed into an annulus shape of the yoke 7, the magnet 6, the plate 5 and the voice coil 4. The diaphragm P, together with the bobbin 3, is vibrated in the direction of the diaphragm P, that is, in the vertical direction (arrow A) of FIG. 1.

Figure 2:
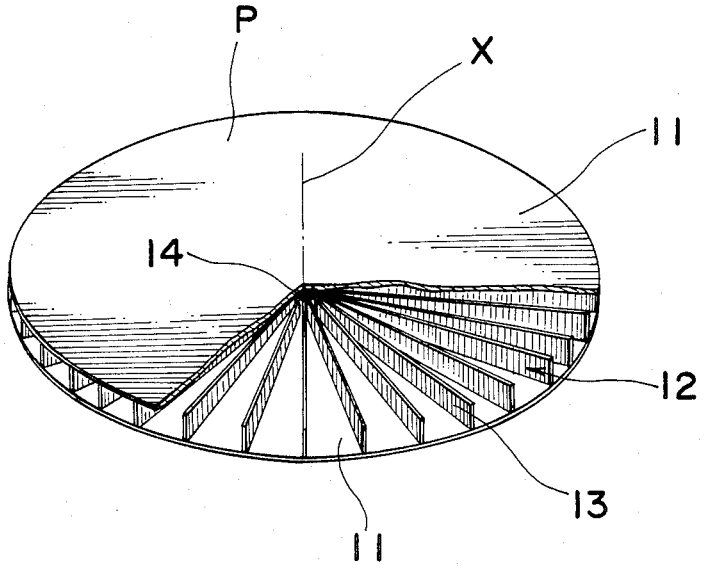
FIG. 2 is a perspective view of the partially broken diaphragm of FIG. 1.

As shown in FIG. 2, the diaphragm P, in accordance with one preferred embodiment of the present invention, which is disc-shaped, is composed of a pair of disc-shaped skin materials 11 disposed on the top and bottom faces of the diaphragm P and a disc-shaped core material 12 to be disposed at the center. The skin materials 11 and the core material 12 are approximately the same in outer diameter, and the skin materials are combined integrally on the top and bottom faces of the core material to constitute one unit. Also, the skin materials 11 and the core material 12 are formed of either a beryllium material or a boron material. Each of the skin materials 11 is composed of a thin flat-plate shaped disc. The core material 12 is composed of one thin flat-plate piece 13 or a plurality of thin flat-plate pieces combined in three-dimensional solid shape. In FIG. 2, a plurality of long-strip flat-plate pieces 13 are erected in parallel along the shaft core X of the diaphragm, disposed in radial directions with the shaft core serving as a center. The tip ends of the flat-plate pieces are secured with respect to each other, with a bonding agent 14, in the shaft core portion where the tip ends of the flat-plate pieces gather. Accordingly, the core material 12 is composed of a plurality of long-strip flat-plate pieces 13, each being equal in radius, which are disposed at their radial directions with the shaft core X of the diaphragm serving as the center. The disc-shaped skin materials 11, 11 are integrally combined, with bonding agent, respectively on the top face and the bottom face of the core material 12, constructed to be cylindrical in shape.

Figure 3:
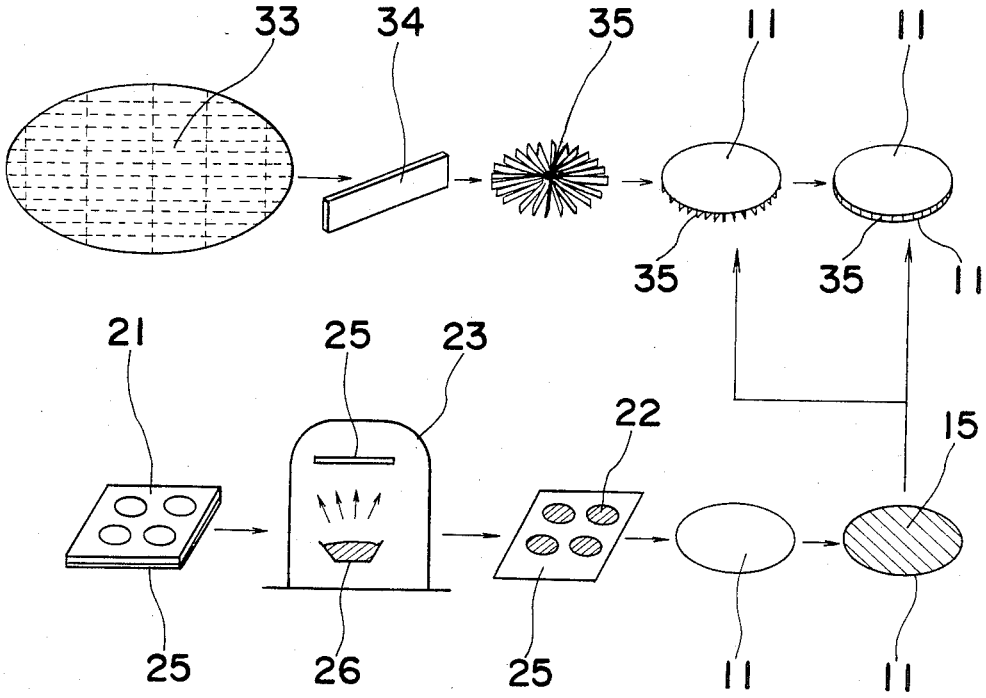
FIG. 3 represents illustrating views each showing a manufacturing process of the diaphragm of FIG. 1.
Figure 4:
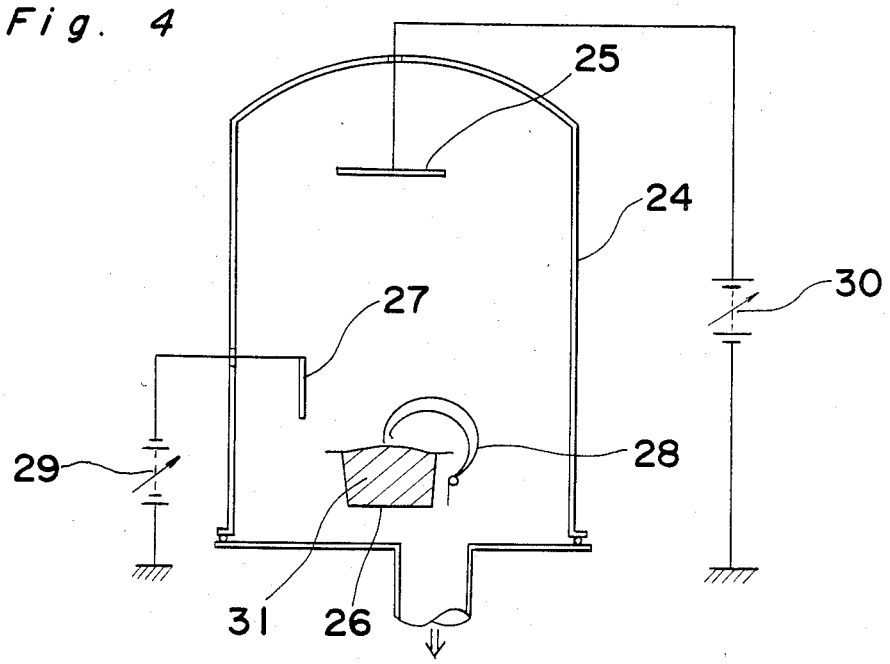
FIG. 4 is a partial enlarged view of FIG. 3.

As shown in FIG. 3, the skin material 11 was made of a boron layer 22, by an electron beam evaporation method, on the surface of the base plate 25 through insertion of a titanium base plate 25, covered with a mask material 21, into a DC ion plating apparatus 23. As shown in FIG. 4, the DC ion plating apparatus 23 has a base plate 25 and a crucible 26 disposed opposite to each other within a bell jar 24 with an exhaust system disposed therein. A thermion acceleration electrode 27 and an electron beam gun 28 are disposed near the crucible 26. A thermion acceleration power-supply 29 of the thermion acceleration electrode 27 and an ion acceleration power-supply 30 as the power supply of the base plate 25 are provided. Boron 31 as an evaporation source was put into the crucible 26. At this time, boron 31 was evaporated in the atmosphere of 1 through $3\times10^{-5}$ Torr to apply +70 V upon the thermion acceleration electrode 27 to accelerate the thermion produced from the crucible 26 to collide against the evaporated particles of the boron 31 so that the boron 31 might be ionized. Also, the boron 31 was evaporated as a film on the surface of the base plate 25. Also, the voltage of −0.5 KV was applied for two minutes from the initial stage of the formation upon the base plate 25 during the formation of the boron film. Thereafter, the voltage was reduced to 0.1 KV to effect the plating operation for twenty-five minutes to form a boron layer 22 of 20 micrometer in thickness on the base plate 25. A titanium leaf of 30 through 50 micron in thickness was used as the base plate 25. The surface of the base plate was covered with a mask material 21 with holes drilled therein each being 28 mm in diameter to form the boron layer 22 of a given size. After the formation of the boron layer 22, the titanium base plate 25 was chemically dissolved and removed in fluorine solution of 0.5 through 1.0% in concentration to produce a skin material 11 made of boron formed as a monofilm.

As shown in FIG. 3, a titanium base plate of 30 micrometer in thickness, formed into a disc shape in advance, was placed on a base jig. A mask material was provided on the top face of the titanium base plate and put into the DC ion plating apparatus. The boron layer was produced by an electron beam evaporation method on the titanium base plate while the rotation was being performed with a rotary shaft provided on the stand jig serving as a center. A boron layer of 20 micrometer in thickness was produced on the titanium base plate.

Thereafter, the titanium base plate was chemically dissolved and removed at a fluorine solution of 0.5 through 1.0 in concentration to produce the boron leaf 33 of 14.0 mm in length, 1.5 mm in width, 0.9 mm in height, and 20 micrometer in thickness. The boron leaf 23 was cut by laser cutting to produce a long-strip boron piece 34 of 14 mm in length, 0.9 mm in height, and 20 micrometer in thickness. A plurality of long-strip boron pieces 34 each being equal in size were disposed in radial directions with the shaft core serving as a center to constitute a entirely cylindrical outer shape. A thermoplastic bonding agent was sprayed on the central portion of the long-strip piece 34 to integrally combine all the long-strip pieces 34 to form one unit 35. The thermo-plastic bonding agent is applied on the both side of the core material 12 formed in this manner. A skin material 11 formed by such a method as described above was placed on both faces of the core material 12 to perform the thermal adherence under the conditions of 200° through 230° C. in temperature, and 1 through 2 kg per $cm^2$ in pressure to provide a disc-shaped diaphragm P of 28 mmϕ in diameter, and 90.4 mg in weight.

Figure 5:
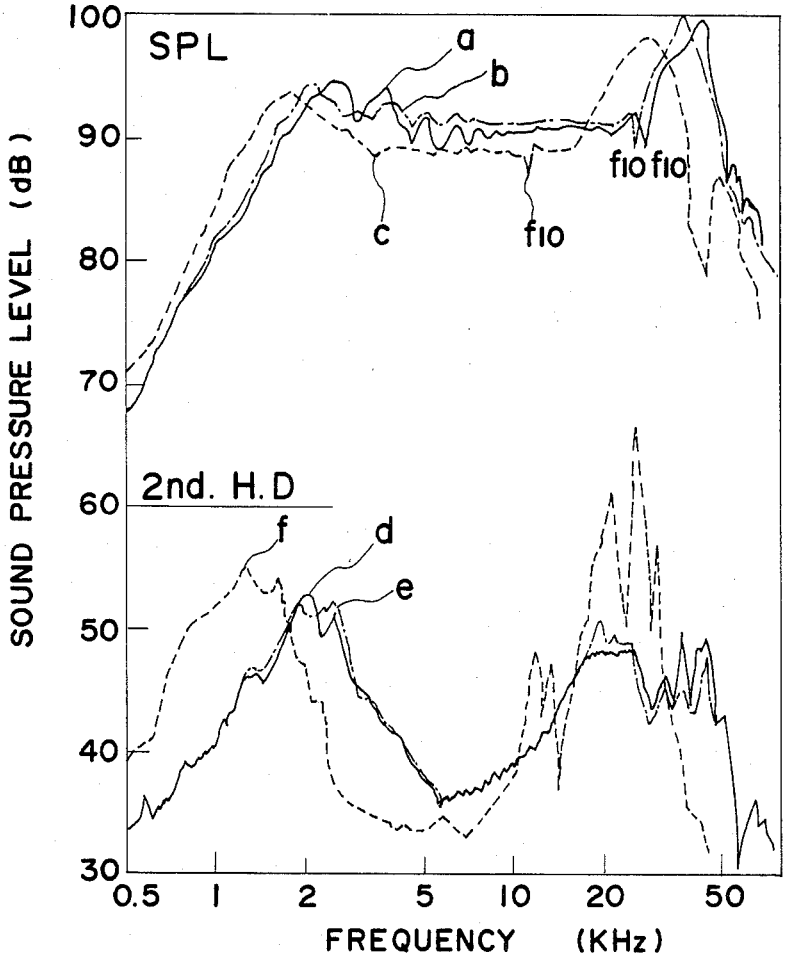
FIG. 5 is an acoustic characteristic graph of a diaphragm, made of boron or beryllium, of FIG. 2.

The diaphragm P provided in such a manner as described above was integrally constructed through connection of disc-shaped skin materials, of approximately the same diameter, on the top face and the bottom face of the disc-shaped core material. The core material was formed as a disc-shaped solid construction with a plurality of flat-plate pieces being independently or serially combined. As the core material and the skin materials were entirely made of boron material, the variable density p of the boron was 2.3 and was lighter than aluminum. Also, the Young's modulus E was $4\times40^{12}$ dyne per $cm^2$ and was larger in flexural rigidity. Accordingly, the resonance frequency f10 of the diaphragm P was as large as 27.3 KHz thus resulting in efficiency as superior as 90.5 dB. The acoustic characteristics of the diaphragm P is shown in a solid line as the frequency (KHz)-sound pressure level (dB) related diaphragm of FIG. 5. The upper solid line a of FIG. 5 shows a sound pressure-frequency of FIG. 5 and the lower solid line d shows a higher harmonic-distortion characteristics. The one-dot chain line of FIG. 5 shows the acoustic characteristics c, f of the conventional aluminum-made diaphragm measured corresponding to those of the diaphragm P of the present invention. An aluminum honey-comb core of isotropic density distribution type of eighty cells was produced each cell being 20 micrometer in thickness and 0.9 mm in height. An aluminum skin material, coated with thermo-plastic bonding agent, of 20 micrometer in thickness and 28 mm in diameter was thermally adhered on the both faces of the aluminum honey-comb core under the conditions of 200° through 230° C. in temperature and 1 through 2 kg per $cm^2$ in pressure to produce a flat-plate diaphragm of 28 mm in diameter and 148 mg in weight. The aluminum diaphragm was 148 mg in weight, 11.5 KHz in primary resonance frequency and 88.7 dB in efficiency. Also, the primary resonance frequency f10 was normally calculated by the following formula.

$$f10 = 1.427\frac{1}{a^2}\sqrt{\frac{EI}{p\cdot t(1-V^2)}}$$

*EI:* flexural rigidity
*E:* Young's modulus
*I:* Coefficiency of cross-section
*a:* diaphragm radius
*p:* density
*t:* diaphragm thickness
*V:* Poisson's ratio As apparent from FIG. 5, according to the boron diaphragm of the present invention, the efficiency was improved by approximately 2 dB (comparison between a and c) in audible zone (2.0 through 20 KHz), the primary resonance frequency and the secondary resonance frequency were extended beyond the audible zone, the peak value was lowered (comparison between d and f), and the distortion was lowered to pole as a whole.

The flat-plate type boron diaphragm of the present invention can provide a loudspeaker of high performance, which is light in weight, high in flexural rigidity, high in efficiency, wide in zone, and low in distortion rate.

Also, the same results can be provided even if such diaphragm P, of the present invention, as described above is made of beryllium material instead of boron material. The method and construction of making the diaphragm of beryllium are completely the same as those of making the diaphragm of boron. Also, the acoustic characteristics of the beryllium diaphragm manufactured are shown in FIG. 5 by the solid line (characteristics of sound pressure and frequency) of the (b) and the dotted line (characteristics of higher harmonics and distortion) of the (e). It can be said that the acoustic characteristics are almost similar to those of FIG. 5. Accordingly, the variable of the beryllium was 1.74 g per $m^3$ and the Young's modulus thereof was $2.8\times10^{12}$ (dyne per $cm^2$). The weight, the primary resonance frequency, efficiency of the beryllium diaphragm were approximately the same as those of the boron diaphragm. Accordingly, it is found out that the beryllium diaphragm is superior to the conventional diaphragm. As described above, according to the present invention, the core material and the skin material, which constitute the diaphragm of sandwich construction type, are made of boron or beryllium to provide a diaphragm for loudspeakers of high performance. It is needless to say that similar characteristics and effects are provided even in the combinations except for those in the above-described embodiment.

Figure 6:
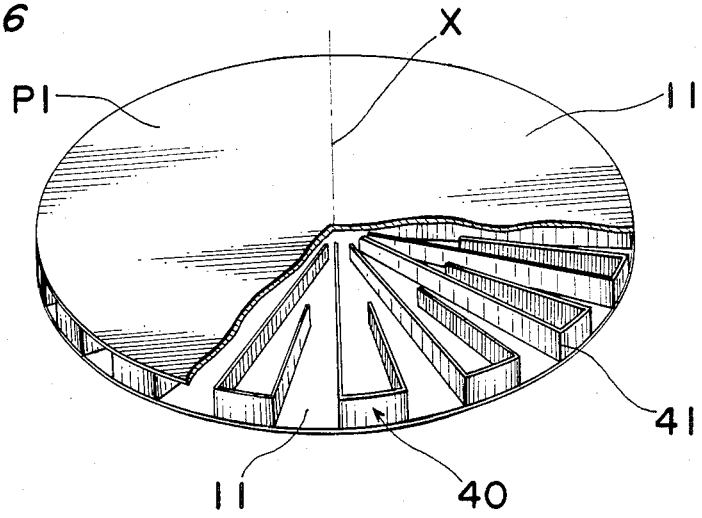
FIG. 6, FIG. 8, and FIG. 10 are perspective views each showing the other modified examples of FIG. 2.

The diaphragm P1 of the present invention shown in FIG. 6 uses L-shaped pieces 41, each being bent into L-shape, instead of long-strip pieces 13 of the diaphragm P of FIG. 1. Namely, the skin material of the diaphragm P1 is the same in construction as the diaphragm P. In the core material 40 of the diaphragm P1, a plurality of L-shaped pieces each being a flat plate bent into L-shape are disposed in parallel along the shaft core X of the diaphragm and in the radial directions with the shaft core serving as a center. The diaphragm of L-shaped pieces formed as described hereinabove is 88.6 mg in weight, 26.4 KHz in first resonance frequency and 90.8 dB in efficiency.

Figure 7:
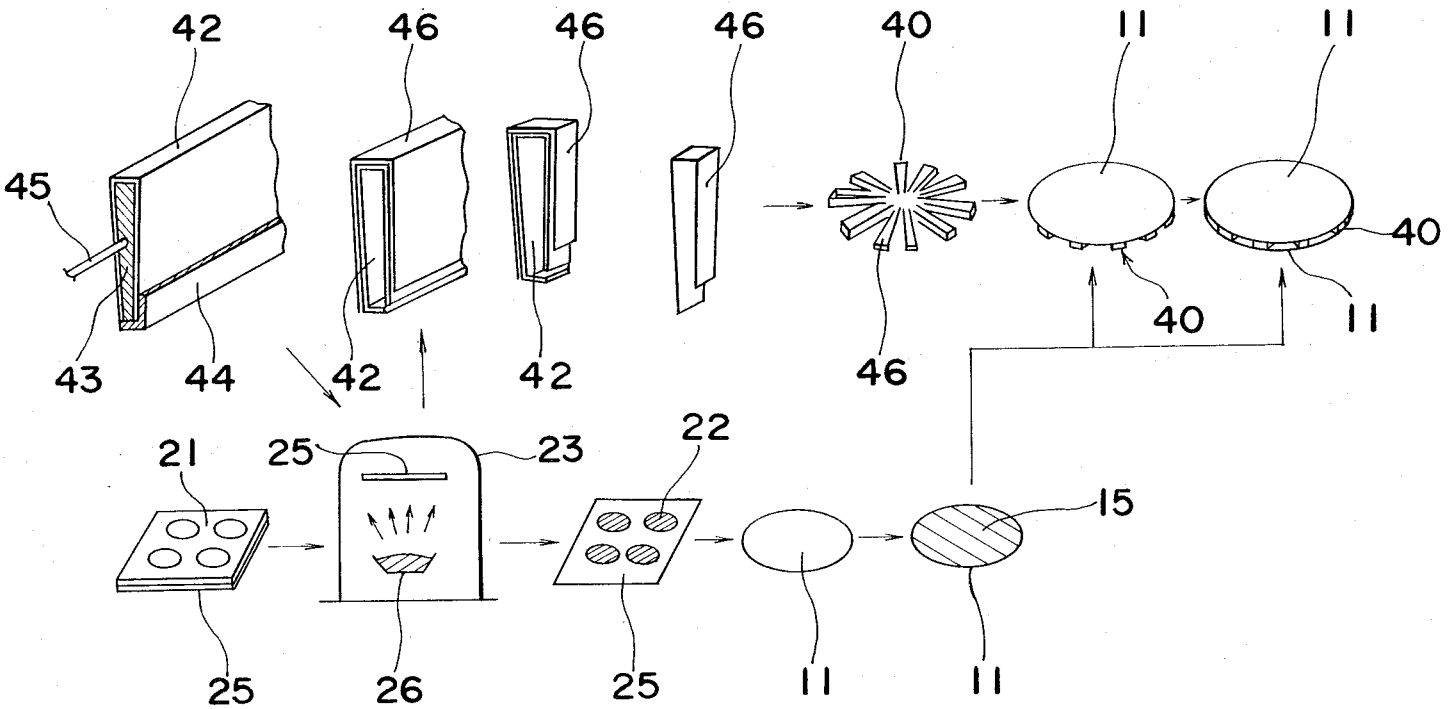
FIG. 7, FIG. 9, and FIG. 11 show illustrating views of the manufacturing processes of the diaphragm of FIG. 6, and FIG. 8.

Also, as shown in FIG. 7, a trapezoidal (in section) core jig 43 was inserted into the titanium base plate 42, of 30 micrometer in thickness, formed previously into U-shape in section. A mask material 44 was provided at the end portion of the titanium base plate 42. It was put into the DC ion plating apparatus. The core material 49 was produced by an electron beam evaporation method while the rotating operation was being performed around a rotary shaft 45 provided in the core jig 43. And a built-up material block, which was composed of a boron layer 46 of 20 micrometer in thickness formed on the titanium base plate 42, was cut into 9 mm in width by a laser cutter. Thereafter, the titanium base plate 42 was chemically dissolved and removed in fluorine solution of 0.5 through 1.0% in concentration to provide a boron L-shaped piece 41 of 13.5 mm in length, 1.5 mm in width, 0.9 mm in height, 20 micrometer in thickness. The plurality of U-shaped pieces 41 were disposed in their radial directions to constitute the core 40. At this time, to produce the boron layer for the core unit 40, the boron was evaporated while the base plate was being rotated in the atmosphere of 1 through $3\times10^{-5}$ Torr through an electron beam evaporation method by the use of the DC ion plating apparatus, as in the skin material, to apply the +70 V upon a thermionic acceleration electrode 3 to accelerate the thermions to be produced from a crucible 26 to cause them to collide against the evaporated particles of the boron thereby to ionize the boron. Also, the voltage of −0.5 KV was applied upon the base plate during the boron formation for two minutes from the initial stage of the formation. Thereafter, the voltage was lowered to 0.1 KV to perform the plating operation for twenty minutes to produce the boron layer of 20 micrometer in thickness on the base plate. Then, the flat boron skin material 11, of 15 micrometer in thickness, coated with thermo-plastic bonding agent was thermally adhered on the both faces of the core 40, under the conditions of 200° through 230° C. in temperature, 1 through 2 kg per $cm^2$ in pressure, to provide a flat-plate diaphragm of 28 mm in diameter.

Figure 8:
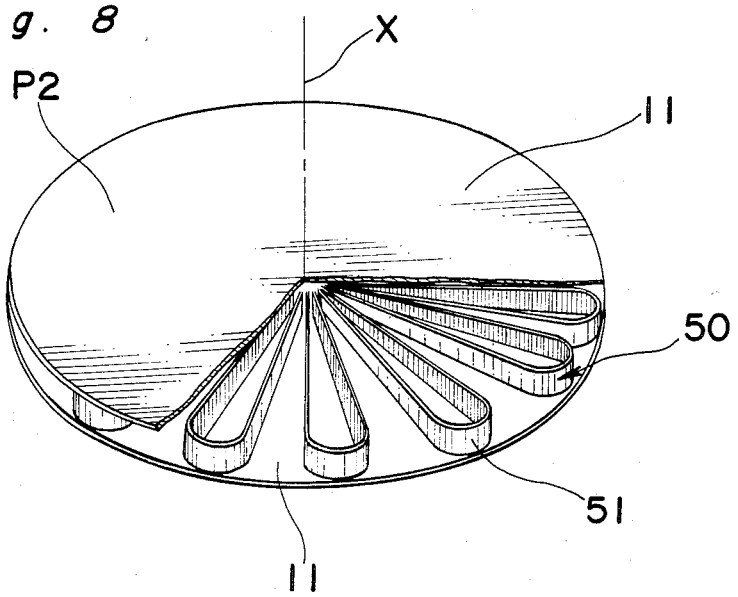

The diaphragm plate P2, of the present invention, shown in FIG. 8 uses U-shaped pieces 51, each being bent into U-shape, instead of the long-strip pieces 13 of the diaphragm of FIG. 1. Namely, the skin material 11 of the diaphragm P2 is the same in construction as the diaphragm P. The core material 50 of the diaphragm P2 has a plurality of U-shaped flat-plate pieces, each being bent into U-shape erected in parallel along the shaft core X of the diaphragm and disposed in radial directions with the shaft core serving as a center. The U-shaped diaphragm formed as described hereinabove was 89 mg in weight, 25.7 KHz in primary resonance frequency and 90.8 dB in efficiency.

Figure 9:
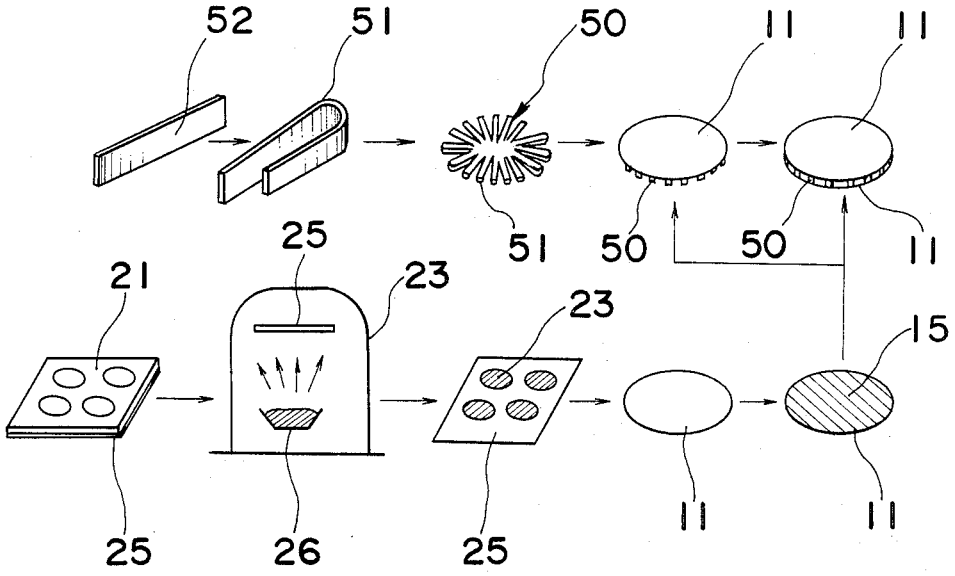

Also, as shown in FIG. 9, a long-strip shaped rib 52 of 28 mm in length, and 0.9 mm in height was cut out of the beryllium flat plate of 20 micrometer in thickness. Thereafter, the middle portion of the rib was heated at its bent portion by a heating rod of 0.5 mm$\phi$ in radius to approximately 300° C. Both ends thereof were bent at 90 degrees to form a U-shaped bent piece 51. The bent pieces were disposed in the radial directions to construct the core 50. The boron skin material, of 20 micrometer in thickness, coated with thermo-plastic bonding agent was thermally adhered on the both faces of the core under the conditions of 200° through 230° C. in temperature and 1 through 2 kg per $cm^2$ in pressure to provide a flat-plate diaphragm of 28 mm$\phi$ in diameter.

Figure 10:
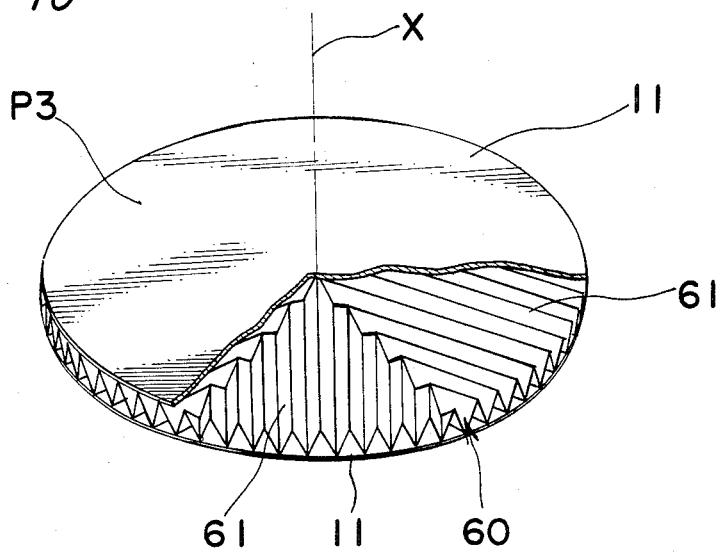
Figure 11:
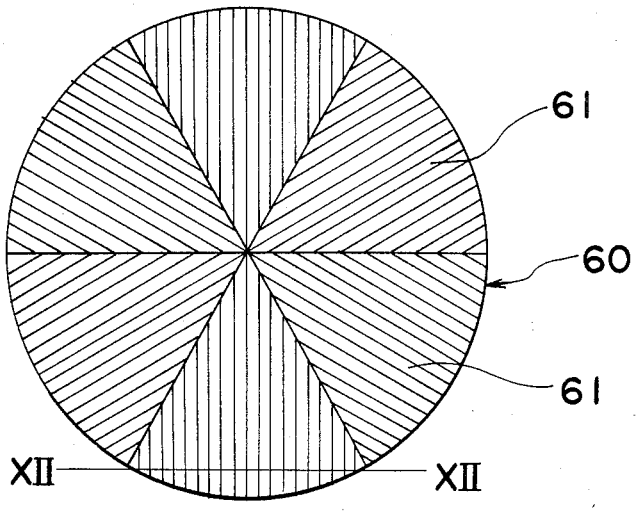
Figure 12:
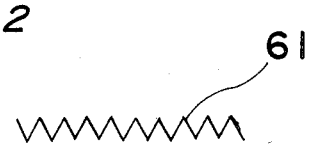
FIG. 12 is a cross-sectional view of FIG. 11.

The diaphragm P3, of the present invention, as shown in FIG. 10 uses fan-shaped plates 61 made into wave forms, instead of the long-strip pieces 13 of the diaphragm P of FIG. 1. Namely, the skin material 11 is the same in construction as the diaphragm P. The core material 60 of the diaphragm P3 uses the three fan-shaped plates or more each plate being approximately the same in shape. The fan-shaped plates are disposed in a ring shape so that they may become disc in shape as a whole. Each of fan-shaped plates is formed into wave forms in section, which have a plurality of folded lines in parallel to the diameter passing through the center of the disc shape. Accordingly, the fan-shaped plates have its long-strip pieces, which are respectively different in appearance, disposed in such W shape as shown in FIG. 12. The respective top, bottom ends are serially connected. The W-shaped folded lines are disposed in parallel with the diameter of such disc-shaped core material as shown in FIG. 11. The diaphragm of the fan-shaped plates formed as described hereinabove was 113 mg in weight, 23.9 KHz in primary resonance frequency, and 89.9 dB in efficiency. A radial, wave-shaped base plate provided with parallel ribs, which were adjacent at 60 degrees to each other, were made of titanium leaf of 50 micrometer in thickness by a pressure mold. A boron layer of 20 micrometer in thickness was formed on the surface of the base plate under the plating conditions shown in the embodiment of FIG. 3. After the formation of the boron layer, the titanium base plate was dissolved and removed in the fluorine solution of 0.5 through 1.0% in concentration to provide a boron core of 28 mm in diameter, and about 0.9 mm in height.

Thereafter, the boron skin material, of 20 micrometer in thickness, coated with thermo-plastic bonding agent was thermally adhered on the both faces of the core under the conditions of 200° through 230° C. and 1 through 2 kg per $cm^2$ in pressure to produce a flat-plate diaphragm of 28 mm$\phi$ in diameter and 113 mg in weight.

Although the present invention has been described and illustrated in detail, it is already understood that the same is by way of illustration and example only and is not to be taken by way of limitation, the spirit and scope of the present invention being limited only by the terms of the appended claims.

What is claimed is:

1. A diaphragm for loudspeakers comprising in combination a pair of skin materials each being formed in disc shape approximately equal in diameter, and a core material comprised of a plurality of plate pieces joined to form a disc-shaped construction having a top face and a bottom face, said pair of skin materials being integrally constructed on said top face and said bottom face of said core material, said skin materials and core material being made both in their entirety of either boron or beryllium low in density and high in modulus of elasticity.

2. A diaphragm for loudspeakers in accordance with claim 1, wherein said core material comprises a plurality of long-strip shaped flat-plate pieces disposed in parallel along a shaft of said core material, disposed in a radial direction, with the shaft of the core material serving as a center thereby forming a disc shape as a whole.

3. A diaphragm for loudspeakers in accordance with claim 1, wherein said core material comprises a plurality of L-shaped plate pieces disposed along the shaft of the core material and disposed in the radial direction, with the shaft of the core material serving as a center thereby to form a disc shape as a whole.

4. A diaphragm for loudspeakers in accordance with claim 1, wherein said core material comprises a plurality of U-shaped plate pieces disposed in parallel along the shaft of the core material and disposed in the radial direction, with the shaft of the core material serving as a center thereby to form a disc shape as a whole.

5. A diaphragm for loudspeakers in accordance with claim 1, wherein said core material comprises three fan-shaped plates or more, each being the same in shape, disposed in a ring shape to form a disc shape as a whole, each of said fan-shaped plates being formed into W-shaped wave forms (in section) having a plurality of folded lines in parallel, with the diameter passing through the center of the disc shape.

* * * * *